US008308265B2

(12) United States Patent
Bansyo

(10) Patent No.: US 8,308,265 B2
(45) Date of Patent: Nov. 13, 2012

(54) INKJET PRINTING APPARATUS

(75) Inventor: Toshihiro Bansyo, Ibaraki-ken (JP)

(73) Assignee: Riso Kagaku Corporation, Tokyo (JP)

( * ) Notice: Subject to any disclaimer, the term of this patent is extended or adjusted under 35 U.S.C. 154(b) by 235 days.

(21) Appl. No.: 12/901,042

(22) Filed: Oct. 8, 2010

(65) Prior Publication Data

US 2011/0085004 A1 Apr. 14, 2011

(30) Foreign Application Priority Data

Oct. 14, 2009 (JP) ..... P2009-237158

(51) Int. Cl.
*B41J 29/38* (2006.01)
*B41J 29/393* (2006.01)
*B41J 2/18* (2006.01)

(52) U.S. Cl. ..... 347/17; 347/19; 347/89

(58) Field of Classification Search ..... 347/17, 347/89, 19
See application file for complete search history.

(56) References Cited

U.S. PATENT DOCUMENTS

2009/0195588 A1* 8/2009 Ogama ..... 347/17

FOREIGN PATENT DOCUMENTS

JP 2004-322411 A 11/2004

* cited by examiner

*Primary Examiner* — Julian Huffman
(74) *Attorney, Agent, or Firm* — Nath, Goldberg & Meyer; Jerald L. Meyer; Stanley N. Protigal

(57) ABSTRACT

An inkjet printing apparatus includes: an array of inkjet heads; a set of heating elements each in a corresponding one of the inkjet heads and each configured to heat ink; an ink circulation route configured to circulate ink through the inkjet heads; an inlet thermometer configured to measure, as first temperatures, ink temperatures of ink each flowing into a corresponding one of the inkjet heads; an outlet thermometer configured to measure, as second temperatures, ink temperatures of ink each flowing out of a corresponding one of the inkjet heads; a heating unit configured to heat ink being circulated; and a controller configured to work with a temperature difference between a first temperature and a second temperature for each same inkjet head to determine allocation of an available power for heating ink to the heating elements and the heating unit.

3 Claims, 5 Drawing Sheets

INKJET PRINTING APPARATUS

CROSS REFERENCE TO RELATED APPLICATION

This application is based upon and claims the benefit of priority from the prior Japanese Patent Application No. 2009-237158, filed on Oct. 14, 2009, the entire contents of which are incorporated herein by reference.

BACKGROUND OF THE INVENTION

1. Field of the Invention

The present invention relates to an inkjet printing apparatus configured to print on a print sheet by ejecting ink from an inkjet head.

2. Description of the Related Art

Generally, inkjet printing apparatuses using the inkjet method are capable of not only printing images, characters, and the like by ejecting ink from nozzles of inkjet heads to print sheets on the basis of print data such as image information and character information, but also of printing the print data on print sheets in colors by use of multiple color inks. Such inkjet printing apparatuses have been widely spread for home and office use.

A well-known example of this type of inkjet printing apparatuses is a line-type inkjet printing apparatus. This inkjet printing apparatus uses multiple inkjet heads in each of which multiple nozzles are arranged in lines extending in a main scanning direction. Thus, the inkjet printing apparatus is capable of printing at least one whole line of print data on a print sheet at once by conveying the print sheet in a sub-scanning direction orthogonal to the main scanning direction, relative to the multiple inkjet heads.

The inks used for such an inkjet printing apparatus have temperature characteristics that their viscosities vary depending on a temperature condition in a way that the viscosities become higher as the temperature decreases and the viscosities become lower as the temperature increases. Particularly in the case where the viscosities of the inks become higher, it is likely that no high-precision printed sheets may be obtained because the droplet diameter and ejection speed of ink droplets become uneven.

With this taken into consideration, Japanese Unexamined Patent Application Publication No. 2004-322411 proposes an image recording apparatus in which: an ink passage is formed in the inside of each of the ink tanks, recording heads, and supply lines; a hot water passage through which to circulate hot water is installed in a vicinity of at least part of each ink passage; temperature sensors configured to sense the temperature of ink in each ink passage are installed in at least two places in the ink passage; and at least one of the temperature and flow rate of the hot water to be circulated through the corresponding hot water passage is controlled depending on the temperature difference between the temperatures sensed by the temperature sensors.

SUMMARY OF THE INVENTION

The image recording apparatus disclosed in Japanese Unexamined Patent Application Publication No. 2004-322411 controls at least one of the temperature and flow rate of the hot water to be circulated through the corresponding hot water passage depending on the temperature difference between the temperatures sensed by the temperature sensors. For this reason, although being capable of making the temperature of the ink even in each ink passage, the image recording apparatus needs the hot water passages through which to circulate the hot water in addition to the ink supply passages through which to supply the inks to the inkjet heads, and brings about a problem of an increase in size and an increase in cost.

Furthermore, the image recording apparatus needs to heat the hot water in addition to the inks, and accordingly consumes a larger amount of electric power. For this reason, it is difficult for the image recording apparatus to efficiently heat the inks to an appropriate temperature.

An object of the present invention is to provide an inkjet printing apparatus which efficiently heats inks to an appropriate temperature regardless of the environmental temperature.

An aspect of the present invention is an inkjet printing apparatus including: an array of inkjet heads; a set of heating elements each in a corresponding one of the inkjet heads and each configured to heat ink; an ink circulation route configured to circulate ink through the inkjet heads; an inlet thermometer configured to measure, as first temperatures, ink temperatures of ink each flowing into a corresponding one of the inkjet heads; an outlet thermometer configured to measure, as second temperatures, ink temperatures of ink each flowing out of a corresponding one of the inkjet heads; a heating unit configured to heat ink being circulated; and a controller configured to work with a temperature difference between a first temperature and a second temperature for each same inkjet head to determine allocation of an available power for heating ink to the heating elements and the heating unit.

The foregoing aspect makes it possible to efficiently heat the ink to an appropriate temperature regardless of the environmental temperature.

The inkjet printing apparatus may further include a temperature judgment unit configured to judge whether the array of inkjet heads include an inkjet head having a temperature difference between a first temperature and a second temperature being equal to or more than a threshold. And the controller may be configured to work upon judgment by the temperature judgment unit that the array of inkjet heads include an inkjet head having a temperature difference between a first temperature and a second temperature being equal to or more than the threshold to select a number of inkjet heads from among the array of inkjet heads in descending order of a temperature difference between a first temperature and a second temperature for each same inkjet head, drive a heating element included in the number of inkjet heads as selected to generate heat with a first electric power smaller than the available power, and drive the heating unit to heat ink with a second electric power to be obtained by subtracting an electric power as consumed by the heating element from the available power.

The foregoing configuration causes the heating units, which are included in a predetermined number of inkjet heads selected depending on the differences in temperature between the first temperatures and the second temperatures, to produce heat with the electric power which is smaller than the available power for heating ink. For this reason, the foregoing configuration makes it possible to more efficiently heat the ink to the appropriate temperature.

The controller may be configured to work upon judgment by the temperature judgment unit that the inkjet heads include no inkjet head having a temperature difference between a first temperature and a second temperature being equal to or more than the threshold to drive the heating unit to heat ink with the available power.

The foregoing configuration makes it possible to efficiently heat the ink to the appropriate temperature even in a case where it is judged whether there is no inkjet head whose temperature difference between the first temperature and the second temperature is not smaller than the threshold.

DETAILED DESCRIPTION OF THE EMBODIMENT

Hereinafter, detailed descriptions will be provided for an embodiment of the present invention with reference to the drawings.

Configuration of Inkjet Printing Apparatus

The embodiment of the present invention will be described by exemplifying an inkjet printing apparatus configured to print images, characters, and the like by ejecting ink from nozzles of inkjet heads to print sheets on the basis of print data such as image information and character information.

Figure 1:
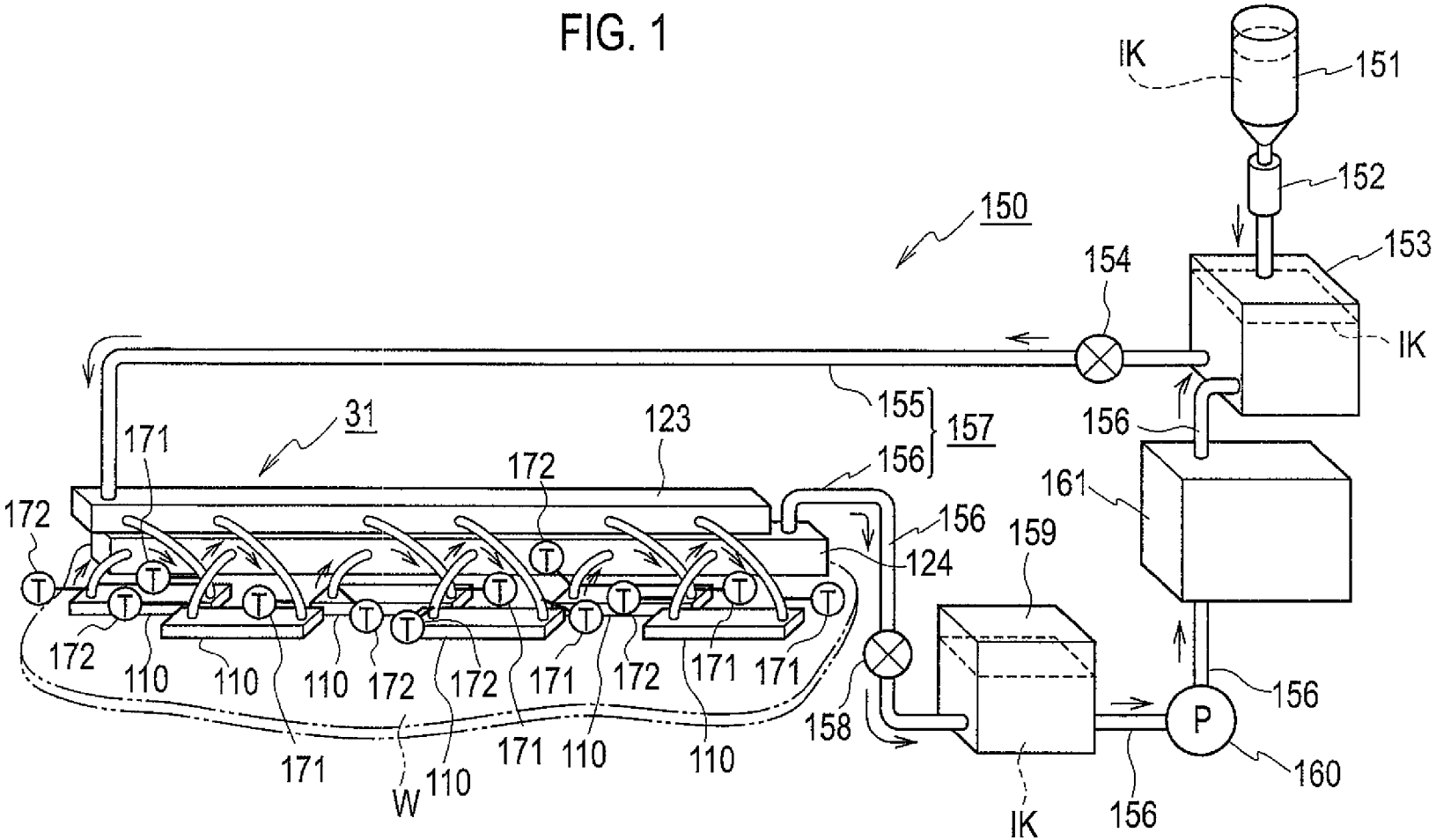
FIG. 1 is a diagram schematically showing an ink circulation route configured to circulate ink to be ejected from nozzles of inkjet heads in an inkjet printing apparatus according to an embodiment of the present invention.

FIG. 1 is a diagram schematically showing an ink circulation route configured to circulate ink to be ejected from nozzles of inkjet heads in the inkjet printing apparatus 1 according to the embodiment of the present invention.

In an ink circulation route section 150 configured to circulate ink IK, as shown in FIG. 1, an ink bottle 151 filled with ink IK is detachably attached to a connecting pipe 152. The ink IK is supplied from the ink bottle 151 to a first ink tank (hereinafter referred to as an "upper ink tank") 153 through the connecting pipe 152, and is thus stored in the upper ink tank 153. In the inkjet printing apparatus 1 according to the embodiment of the present invention, ink IK is supplied from the replaceable ink bottle 151 to the inside of the upper ink tank 153. Instead, however, by providing an ink supply port (not illustrated) to the upper ink tank 153 without attaching the ink bottle 151, ink IK may be supplied to the upper ink tank 153 from the ink supply port.

The upper ink tank 153 and an ink supply chamber 123, which is placed upstream in the inside of an inkjet head unit 31, are connected together through an ink supply route 155. A first solenoid valve 154 configured to control switching on/off of the ink supply route 155 is installed on the ink supply route 155.

An ink recovery chamber 124, a second ink tank (hereinafter referred to as a "lower ink tank) 159, a pump 160, a heat exchanger 161, and the upper ink tank 153 are connected together through an ink recovery route 156. The ink recovery chamber 124 is placed downstream in the inside of the inkjet head unit 31. The lower ink tank 159 is configured to store ink IK which is recovered from the ink recovery chamber 124. Due to their connection, the ink IK once stored in the lower ink tank 159 is transferred by a pump 160 to the heat exchanger 161. In addition, the flow of the ink IK in the ink recovery route 156 is regulated in response to the control of switching on/off of a second solenoid valve 158.

Accordingly, in a case where ink IK is circulated in an ink circulation route 157 including the ink supply route 155 and the ink recovery route 156, once the first and second solenoid valves 154, 158 provided in the ink circulation route section 150 are switched on, ink IK stored in the upper ink tank 153 passes the inside of the ink supply route 155, and is thus supplied to the inside of the ink supply chamber 123 in the inkjet head unit 31. Subsequently, the ink IK is distributed from the ink supply chamber 123 to multiple inkjet heads 110 which are arranged two-dimensionally. The ink IK is selectively ejected from each inkjet head 110 to a print sheet W.

After the ink IK is selectively ejected from each inkjet head 110 to the print sheet W, the rest of the ink IK is recovered from the inkjet head 110 to the inside of the ink recovery chamber 124. Ink IK from the ink recovery chamber 124 passes the inside of the ink recovery route 156, and is temporarily stored in the lower ink tank 159.

Thereafter, the ink IK in the lower ink tank 159 is transferred by the pump 160 to the heat exchanger 161. The ink IK is supplied to the upper ink 153 so that the heat exchanger 161 heats the ink IK in the ink circulation route 157 to a predetermined temperature.

A first detector 171 is provided on each line to which ink IK flows from the ink supply chamber 123 and which then allows the ink IK to flow to each of the inkjet heads 110. The first detector 171 is configured to measure the temperature of the ink IK thus flowed thereto.

A second detector 172 is provided on each line to which ink IK flows from each of the inkjet heads 110 and which then allows the ink IK to flow to the ink recovery chamber 124. The second detector 172 is configured to measure the temperature of the ink IK thus flowed therefrom.

Figure 2A:
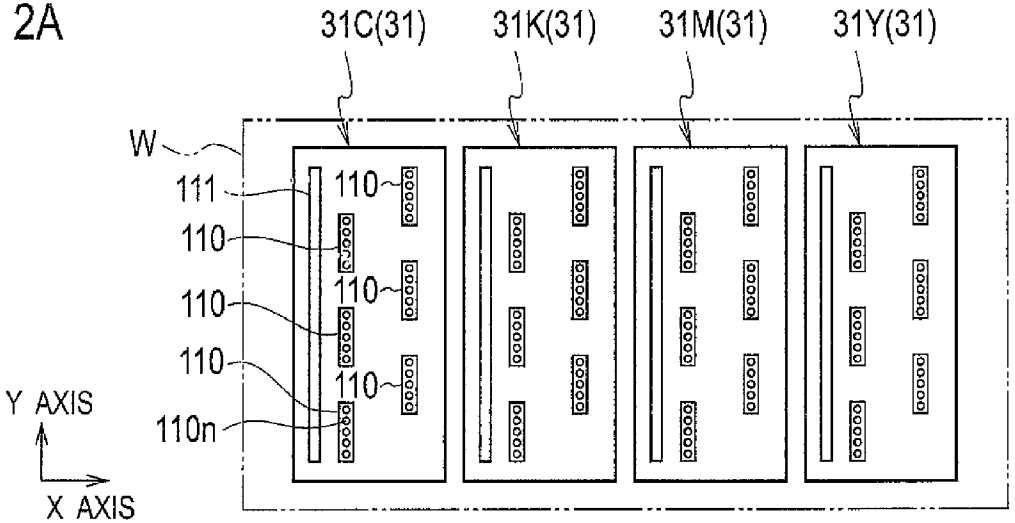
FIG. 2A is an enlarged plan view of inkjet heads and their periphery which are included in the inkjet printing apparatus according to the embodiment of the present invention.
Figure 2B:
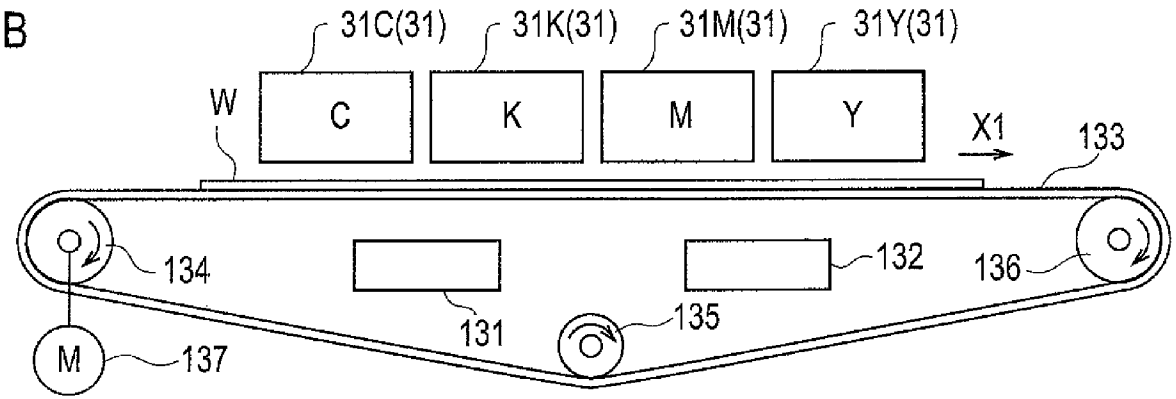
FIG. 2B is an enlarged side view of the inkjet heads and their periphery which are included in the inkjet printing apparatus according to the embodiment of the present invention.

FIG. 2A is an enlarged plan view of the inkjet head units and their periphery which are included in the inkjet printing apparatus 1 according to the embodiment of the present invention. FIG. 2B is an enlarged side view of the inkjet head units and their periphery which are included in the inkjet printing apparatus 1 according to the embodiment of the present invention.

As shown in FIGS. 2A and 2B, the inkjet head units 31 are provided for the respective colors in order to correspond to the multiple color inks. In the inkjet printing apparatus 1 according to the embodiment of the present invention, for example, inks of C (cyan), K (black), M (magenta), and Y (Yellow) are used for the multiple color inks for printing in colors print data inputted into the inkjet printing apparatus 1. To this end, in the inkjet printing apparatus 1, multiple inkjet head lines 31C, 31K, 31M, 31Y corresponding to the respective ink colors C, K, M, Y are arranged in order of C, K, M to Y, or in order of printing in the direction in which print sheets W are conveyed (in the direction indicated by an arrow X1).

All of the multiple inkjet head lines 31C, 31K, 31M, 31Y are configured by the same structure. For this reason, descriptions will be hereinbelow provided only for the inkjet head line 31C, and descriptions for the other inkjet head lines will be omitted.

The inkjet head line 31C has a head driver circuit 111 in its inside. In addition, multiple inkjet heads 110 are arranged two-dimensionally in the inkjet head line 31C. Each inkjet head 110 has multiple nozzles 110*n* which are arranged in the main scanning direction (in the Y-axis direction). Specifically, six inkjet heads 110 are arranged in a staggered pattern in a way that: the inkjet heads 100 are arranged in two lines extending in the sub-scanning direction (in the X-axis direction); three inkjet heads 110 are arranged along each line extending in the main scanning direction (in the Y-axis direction); and the inkjet heads 110 situated in one of the two neighboring lines 1, 2 partially overlap the inkjet heads 110 situated in the other of the two neighboring lines 1, 2.

For the sake of illustration convenience, in the inkjet printing apparatus 1 according to the embodiment of the present invention, the six two-dimensionally arranged inkjet heads 110 are arranged in a staggered manner in a way that, for instance, three inkjet heads 110 are arranged in each of the lines 1, 2. However, the number of inkjet heads 100 arranged in each line is not limited to three. Four or more inkjet heads 110 may be arranged in each line.

As shown in FIG. 2B, the inkjet printing apparatus 1 includes a circular conveyer belt 133, first to third pulleys 134 to 136, a motor 137, and suction fans 131, 132. The conveyer belt 133 has multiple air suction holes (not illustrated) which penetrate the conveyer belt 133 at almost equal intervals. The first to third pulleys 134 to 136 are those around which the conveyer belt 133 is wound. The motor 137 is linked to the first pulley 134 in order to make the conveyer belt 133 rotate. The suction fans 131, 132 are configured to suck air through the multiple air suction holes formed in the conveyer belt 133.

When a print sheet W is transferred to the circular conveyer belt 133, the suction fans 131, 132 cause this print sheet W to attach to the conveyer belt 133 by sucking the air through the multiple air suction holes formed in the conveyer belt 133. While being attached to the conveyer belt 133, the print sheet W is conveyed in the sub-scanning direction (in the direction indicated by the arrow X1) by the rotation of the conveyer belt 133. While the print sheet W is being conveyed, ink is ejected from the inkjet heads 110 in response to the drive of the head driver circuit 111.

Ink reservoir chambers to contain a C (cyan) ink are included in each inkjet head 110 (although not illustrated). As a piezoelectric element, a piezo-element (not illustrated) is placed in each ink reservoir chamber. When an ejection voltage is applied to this piezo-element, ink is ejected from a nozzle communicating with the corresponding ink reservoir chamber.

If the multiple piezo-elements included in each inkjet head 110 are caused to produce heat through such micro-vibrations that no ink IK are ejected, the multiple piezo-elements can serve as heating elements which are capable of heating the inkjet head 110 and the corresponding ink IK. This operation of the piezo-elements is termed as anon-ejection drive.

Inkjet heads for the black (K), magenta (M), and yellow (Y) colors, which are included in the other inkjet head units 31, have the inkjet heads 110 of the same configuration.

As described above, the inkjet printing apparatus 1 according to the embodiment of the present invention prints on the sheet W, which is conveyed in the sub-scanning direction (in the conveyance direction), by ejecting ink continuously in the main scanning direction from the six inkjet heads for each of the black (K), cyan (C), magenta (M), and yellow (Y) colors.

Figure 3:
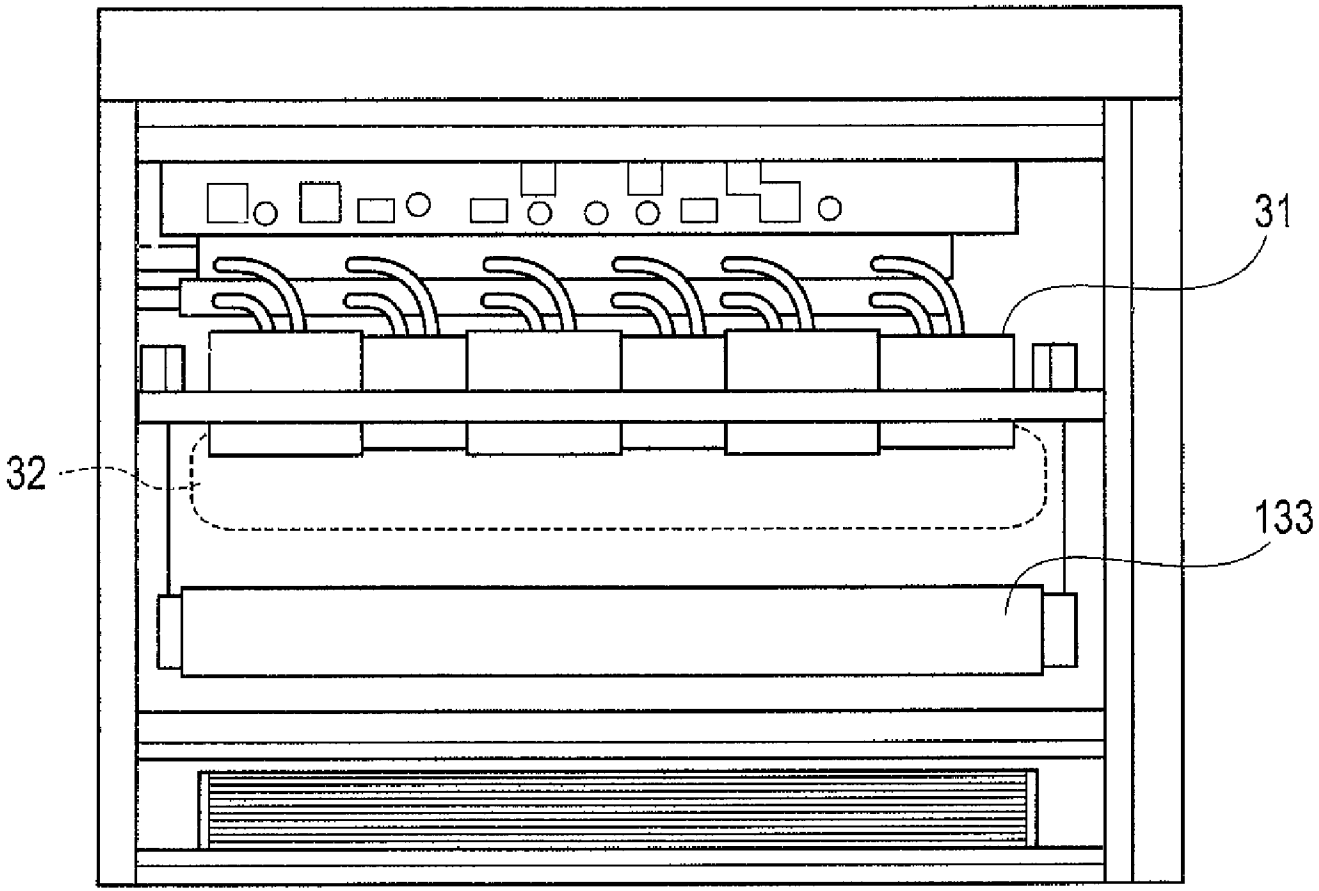
FIG. 3 is a diagram showing an internal configuration of the inkjet printing apparatus according to the embodiment of the present invention, which is viewed sideways of the apparatus.

FIG. 3 is a diagram showing an internal configuration of the inkjet printing apparatus 1 according to the embodiment of the present invention, which is viewed sideways of the apparatus.

FIG. 3 shows the internal configuration of the inkjet printing apparatus 1 which is viewed sideways, that is to say, from the upstream side in the direction in which print sheets W are conveyed. A predetermined interstice 32 is provided between the conveyer belt 133 and ejection surfaces of the respective inkjet head units 31. Thus, the ejection surfaces of the respective inkjet head units 31 are likely to dissipate their heat by the air which flows into this interstice 32 from the outside of the apparatus. When the inkjet head units 31 are not heated, the ejection surfaces of the inkjet head units 31 maybe naturally cooled down to a temperature which is close to the environmental temperature.

When, as described above, the inkjet head units 31 are naturally cooled down to a temperature which is close to the environmental temperature, the difference in temperature between ink and each inkjet head units 31 is larger, and the amount of heat dissipated via the inkjet head unit 31 is larger. In such a case, the ink may not be heated efficiently only by heating circulated ink with the heat exchanger, which will be described later.

With this taken into consideration, the inkjet printing apparatus 1 according to the embodiment of the present invention is designed to efficiently heat ink up to a temperature appropriate for the printing even in a case where the temperature difference between the ink temperature and the environmental temperature is large.

Functional Configuration of Inkjet Printing Apparatus 1

Next, descriptions will be provided for a functional configuration of the inkjet printing apparatus 1 according to the embodiment of the present invention.

Figure 4:
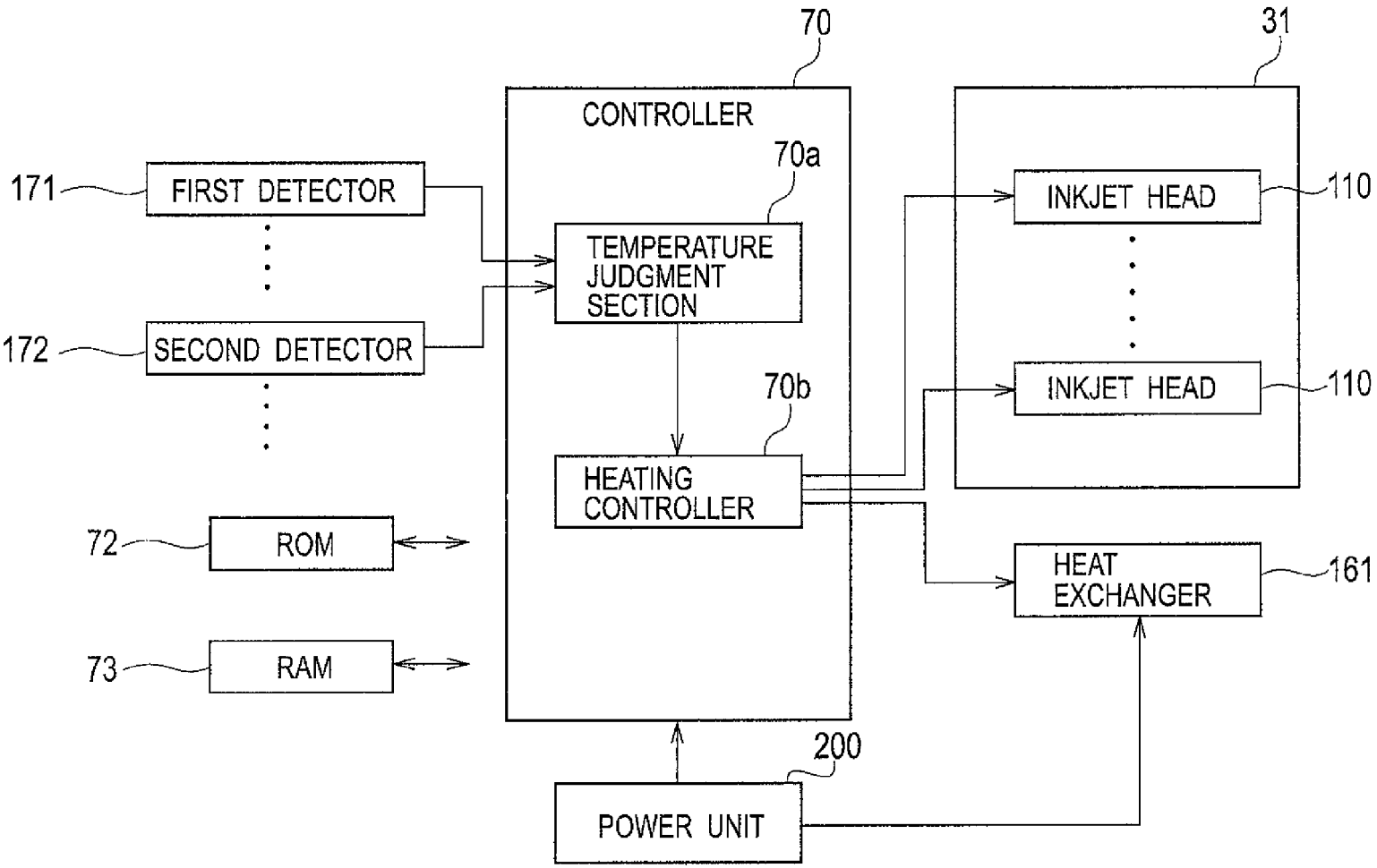
FIG. 4 is a diagram showing a functional configuration of the inkjet printing apparatus according to the embodiment of the present invention.

FIG. 4 is a diagram showing the functional configuration of the inkjet printing apparatus 1 according to the embodiment of the present invention.

As shown in FIG. 4, the inkjet printing apparatus 1 includes first detectors 171 (an inlet thermometer), second detectors 172 (an outlet thermometer), a ROM 72, a RAM 73, the inkjet head units 31, the heat exchanger 161 as a heating unit, a controller 70, and a power unit 200. Among these, the inkjet head units 31 and the heat exchanger 161 have already been described above. For this reason, descriptions thereof will be omitted.

The power unit 200 is configured to supply electric power to the controller 70 and the heat exchanger 161.

One first detector 171 is provided for each of 24 inkjet heads 110. The first detector 171 is configured to measure the temperature of ink which flows from the ink supply chamber 123 to the inkjet head 110, and to supply the thus-measured ink temperature, as a first temperature, to the controller 70 in each predetermined cycle.

One second detector 172 is provided for each of 24 inkjet heads 110. The second detector 172 is configured to measure the temperature of ink which flows from each of the 24 inkjet heads 110 to the ink recovery chamber 124, and to supply the thus-measured ink temperature, as a second temperature, to the controller 70 in each predetermined cycle.

The ROM 72 is made of a non-volatile semiconductor or the like. The ROM 72 stores therein various control programs to be executed by the controller 70.

The RAM 73 is made of a volatile semiconductor or the like. The RAM 73 stores therein data such as one needed for the controller 70 to execute the various control programs. In addition, the RAM 73 temporarily stores therein a total of 48 pieces of temperature data which are supplied from the first detectors 171 and the second detectors 172 in each predetermined cycle. Specifically, in each predetermined cycle, the RAM stores therein the total of 48 pieces of temperature data which represent the first temperatures and the second temperatures. Each of the first temperatures and each of the second temperatures are supplied from each of the six inkjet heads 110 which are provided for each of the inkjet head lines 31C, 31K, 31M, 31Y.

The controller 70 is configured to centrally control the inkjet printing apparatus 1. In addition, the controller 70 includes a temperature judgment unit 70*a* and a heating controller 70*b* in order to pursue its function.

The temperature judgment unit 70*a* is configured to judge whether, among the multiple inkjet heads 110 (the 24 inkjet heads 110 in this case), there is any inkjet head 110 whose temperature difference between the first temperature and the second temperature is equal to or more than a predetermined temperature difference threshold.

In a case where the temperature judgment unit 70*a* judges that there is at least one inkjet head 110 whose temperature difference between the first temperature and the second temperature is equal to or more than the predetermined temperature difference threshold, the heating controller 70*b* selects a predetermined number of inkjet heads 110 from among the multiple inkjet heads 110 (the 24 inkjet heads 110 in this case) in descending order of the temperature differences between the first temperatures and the second temperatures. The heating controller 70*b* then causes the piezo-elements, which are included in each of the thus-selected predetermined number of inkjet heads, to produce heat with an electric power which is smaller than an power supply available power, and causes the heat exchanger 161 to heat the corresponding ink with a surplus electric power obtained by subtracting the electric power consumed by the piezo-elements from the power supply available power.

In addition, when the temperature judgment unit 70*a* judges that there is no inkjet head 110 whose temperature difference between the first temperature and the second temperature is equal to or more than the predetermined temperature difference threshold, the heating controller 70*b* causes the heat exchanger 161 to heat the inks with the power supply available power.

As just described, the heating controller 70*b* determines allocation of the power supply available power to the piezo-elements and the heat exchanger 161 on the basis of a temperature difference between a first temperature and a second temperature for each same inkjet head 110.

Operation of Inkjet Printing Apparatus 1

Next, descriptions will be provided for an operation of the inkjet printing apparatus 1 according to the embodiment of the present invention.

Figure 5:
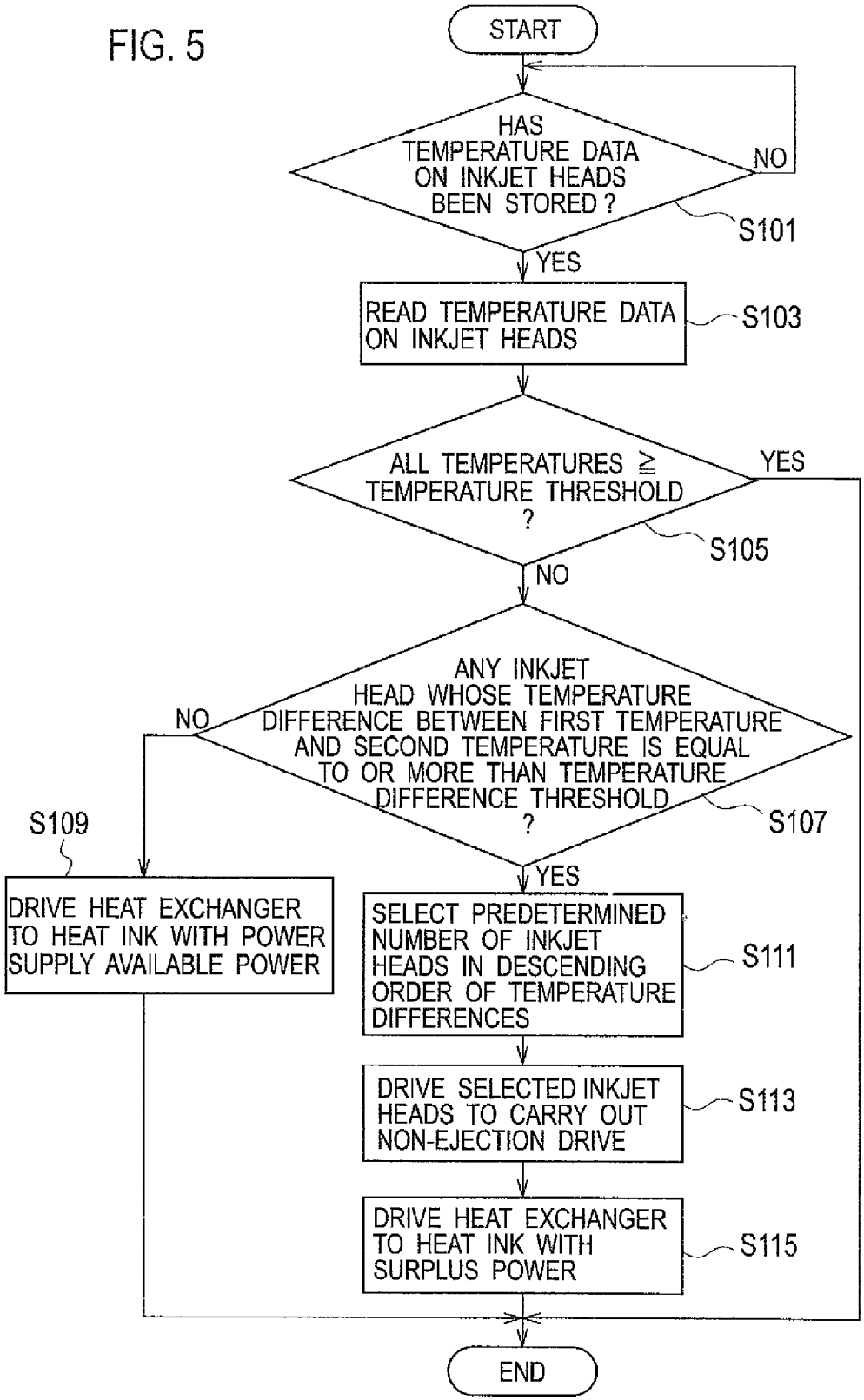
FIG. 5 is a flowchart showing a process procedure of the inkjet printing apparatus according to the embodiment of the present invention.

FIG. 5 is a flowchart showing a process procedure of the inkjet printing apparatus 1 according to the embodiment of the present invention.

As shown in FIG. 5, when the total of 48 pieces of temperature data supplied from the first and second detectors 171, 172 in each predetermined cycle are stored in the RAM 73 (in step S101), the controller 70 reads the total of 48 pieces of temperature data which are stored in the RAM 73 (in step S103).

Subsequently, the temperature judgment unit 70*a* of the controller 70 judges whether all of the thus-read 48 pieces of temperature data are equal to or more than a predetermined temperature threshold (in step S105). In this respect, the temperature threshold should be beforehand set at, for instance, 25 (° C.), as a temperature which allows the inks to be ejected adequately. The present invention is not limited to this temperature 25 (° C.).

If it is judged in step S105 that all of the read 48 pieces of temperature data are equal to or more than the predetermined temperature threshold (if YES), the process procedure is terminated.

If it is judged in step S105 that not all of the read 48 pieces of temperature data are equal to or more than the predetermined temperature threshold (if NO), the temperature judgment unit 70*a* of the controller 70 judges whether, among the total of 24 inkjet heads 110, there is any inkjet head 110 whose temperature difference between the first temperature and the second temperature is equal to or more than the predetermined temperature difference threshold (in step S107). In this respect, if the temperature difference threshold is set too low, the ink IK is heated by the non-ejection drive of the piezo-element although the ink IK can be heated more efficiently by the heat exchanger 161. Conversely, if the temperature difference threshold is set too high, the ink IK is heated by the heat exchanger 161 although the ink can be heated more efficiently by the non-ejection drive of the piezo-element. For this reason, the manufacturer or the like of the inkjet printing apparatus 1 according to the embodiment of the present invention should set the temperature difference threshold at an appropriate value, for instance, 3 (° C.), by beforehand calculating the appropriate value on the basis of actual measurements. The present invention is not limited to this temperature difference 3 (° C.).

If it is judged in step S107 that there is no inkjet head 110 whose temperature difference between the first temperature and the second temperature is equal to or more than the predetermined temperature difference threshold (if NO), the heating controller 70*b* of the controller 70 causes the heat exchanger 161 to heat the inks with the power supply available power (in step S109). Thereafter, the process procedure is terminated. In this respect, the power supply available power (an allowable electric power available for heating ink) means a maximum electric power which the inkjet printing apparatus 1 can use to heat the inks, and is specified at 1000 watts, for instance, depending on the power rating of the power supply (the power unit 200).

On the other hand, if it is judged in step S107 that there is any inkjet head 110 whose temperature difference between the first temperature and the second temperature is equal to or more than the predetermined temperature threshold (if Yes), the heating controller 70*b* of the controller 70 selects the predetermined number of inkjet heads 110 from among the 24 inkjet heads 110 in descending order of the temperature differences between the first temperatures and the second temperatures (in step S111). In this respect, the predetermined number is defined in advance in such a way that the electric power used by the heat exchanger 161 for the heating purpose is balanced with the electric power used by the piezo-elements through their non-ejection drives for the hearting purpose. The predetermined number is set at 6, for instance. The present invention is not limited to the number 6.

Subsequently, the heating controller 70*b* of the controller 70 causes the piezo-elements, which are included in each of the thus-selected predetermined number of inkjet heads 110, to produce heat through their non-ejection drives with the electric power which is smaller than the power supply available power (in step S113). Specifically, the heating controller 70*b* causes the multiple piezo-elements, which are included in each of the inkjet heads 110, to produce heat through such micro-vibrations that no ink IK is ejected. Thereby, the heating controller 70*b* causes the inkjet head 110 and the ink IK to be heated.

Thereafter, the heating controller 70*b* causes the heat exchanger 161 to heat the inks IK with the surplus electric power obtained by subtracting the electric power consumed in step S113, that is to say, the electric power consumed by the piezo-elements, from the power supply available power (in step S115). For instance, in a case where the electric power consumed by the piezo-elements is 600 watts, the heating controller 70*b* causes the heat exchanger 161 to heat the inks IK with the surplus electric power of 400 watts (=1000 watts-600 watts). Thereafter, the process procedure is terminated.

As described above, the inkjet printing apparatus 1 according to the embodiment of the present invention heats each ink IK through the non-ejection drives of the piezo-elements with the electric power smaller than the power supply available power on the basis of the differences in temperature between the first temperatures and the second temperatures, and also heats the ink IK by use of the heat exchanger 161 with the surplus electric power which is obtained by subtracting the electric power consumed by the non-ejection drives of the piezo-elements from the available power. For this reason, the inkjet printing apparatus 1 is capable of efficiently heating each ink IK to an appropriate temperature regardless of the environmental temperature of the inkjet printing apparatus 1.

In addition, in the case where the temperature judgment unit 70*a* judges that, among the 24 inkjet heads 110, there is any inkjet head 110 whose temperature difference between the first temperature and the second temperature is equal to or more than the predetermined temperature difference threshold, the inkjet printing apparatus 1 according to the embodiment of the present invention selects the six inkjet heads 110 from among the 24 inkjet heads 110 in descending order of temperature differences between the first temperatures and the second temperatures. The inkjet printing apparatus 1 causes the piezo-elements, which are included in the thus selected six inkjet heads 110, to produce heat with the electric power which is smaller than the power supply available power. To this end, the inkjet printing apparatus 1 causes the piezo-elements to carry out their non-ejection drives, the piezo-elements included in the predetermined number or less of inkjet heads 110 which cool the inks IK most among the inkjet heads 110 by which the inks IK are most likely to be cooled while passing the inkjet heads 110. For this reason, the inkjet printing apparatus 1 is capable of efficiently heating the inks IK to the appropriate temperature while keeping the electric power consumed by the inkjet printing apparatus 1 within a range not exceeding the power supply available power.

Furthermore, in the case where the temperature judgment unit 70*a* of the controller 70 judges that, among the 24 inkjet heads 110, there is no inkjet head 110 whose temperature difference between the first temperature and the second temperature is equal to or more than the predetermined temperature difference threshold, that is to say, in the case where all the inkjet heads are naturally cooled having small differences in temperature, the heating controller 70*b* causes the heat exchanger 161 to heat the inks IK with the power supply available power. This can heat the inks IK to an appropriate temperature with the power supply available power more efficiently than the non-ejection drives of the piezo-elements.

The embodiment of the present invention has been described by exemplifying the inkjet printing apparatus 1: which heats the inks IK through the non-ejection drives of the piezo-elements with the electric power, which is smaller than the power supply available power, on the basis of the differences in temperature between the first temperatures and the second, temperatures; and which also heats the inks IK with the heat exchanger 161 with the surplus electric power which is obtained by subtracting the electric power consumed by the non-ejection drives of the piezo-elements from the power supply available power. It should be noted, however, that the present invention is not limited to this example.

For instance, the heating of the inks IK may be achieved by a heater using an electric power, which is smaller than the power supply available power, on the basis of the differences in temperature between the first temperatures and the second temperatures, and also by the heat exchanger 161 with the surplus electric power obtained by subtracting the electric power consumed by the heater from the power supply available power.

Specifically, when the temperature judgment unit 70*a* judges that, among the 24 inkjet heads 110, there are inkjet heads 110 whose differences in temperature between the first temperatures and the second temperatures are not smaller than the predetermined temperature difference threshold, the heating controller 70*b* of the controller 70 selects the predetermined number of inkjet heads 110 from among the 24 inkjet heads 110 in descending order of the temperature differences between the first temperatures and the second temperatures. Thus, the heating controller 70*b* causes heaters, which are included in the thus-selected predetermined number of inkjet heads 110, to produce heat with the electric power which is smaller than the power supply available power, and also causes the heat exchanger 161 to heat the ink IK with the surplus electric power which is obtained by subtracting the electric power consumed by the heaters from the power supply available power.

Thereby, the inkjet printing apparatus 1 is capable of heating the inks IK to an appropriate temperature more efficiently regardless of the environmental temperature of the inkjet printing apparatus 1.

Moreover, although the embodiment of the present invention adopts the piezo-method using the piezo-elements as the heating bodies, the present invention is not limited to this. Instead, for instance, the present invention may adopt: an electrostatic method of ejecting ink, which is stored in an ink reservoir chamber, through a nozzle by displacing a vibration plate through application of an ejection voltage to a electrostatic gap; and a film-boiling inkjet method of ejecting ink through a nozzle by means of change in pressure due to bubbles in a film-boiling condition which are produced by heating the ink with a micro-heater within an ink reservoir chamber.

An inkjet printing apparatus according to the embodiment of the present invention has been described above. However, the invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

Moreover, the effects described in the embodiment of the present invention are only a list of optimum effects achieved by the present invention. Hence, the effects of the present invention are not limited to those described in the embodiment of the present invention.

What is claimed is:

1. An inkjet printing apparatus comprising:

an array of inkjet heads;

a set of heating elements each in a corresponding one of the inkjet heads and each configured to heat ink;

an ink circulation route configured to circulate ink through the inkjet heads;

each head having at least one inlet thermometer configured to measure, as a first temperature, a temperature of ink flowing into the respective head;

each head having at least one outlet thermometer configured to measure, as a second temperature, a temperature of ink flowing out of the respective head;

a heating unit configured to heat ink being circulated; and a controller configured to work with a temperature difference between said first temperature and said second temperature for each inkjet head to determine allocation of an available power for heating ink to the heating elements and the heating unit.

2. The inkjet printing apparatus according to claim 1, further comprising a temperature judgment unit configured to judge whether the array of inkjet heads include an inkjet head having a temperature difference between the first temperature and the second temperature being equal to or more than a threshold, wherein the controller is configured to work upon judgment by the temperature judgment unit that the array of inkjet heads include an inkjet head having a temperature difference between the first temperature and the second temperature being equal to or more than the threshold to select a number of inkjet heads from among the array of inkjet heads in descending order of a temperature difference between the first temperature and the second temperature for each same inkjet head, drive a heating element included in the number of inkjet heads as selected to generate heat with a first electric power smaller than the available power, and drive the heating unit to heat ink with a second electric power to be obtained by subtracting an electric power as consumed by the heating element from the available power.

3. The inkjet printing apparatus according to claim 2, wherein the controller is configured to work upon judgment by the temperature judgment unit that the inkjet heads include no inkjet head having a temperature difference between the first temperature and the second temperature being equal to or more than the threshold to drive the heating unit to heat ink with the available power.

* * * * *